United States Patent [19]

Rowe

[11] 3,956,990

[45] May 18, 1976

[54] BEEHIVE PROJECTILE

[75] Inventor: John F. Rowe, Dover, N.J.

[73] Assignee: The United States of America as represented by the Secretary of the Army, Washington, D.C.

[22] Filed: July 31, 1964

[21] Appl. No.: 387,557

[52] U.S. Cl. ..... 102/69; 102/7.2; 102/34.4; 102/67; 102/DIG. 7

[51] Int. Cl.[2] ..... F42B 13/50

[58] Field of Search ..... 102/67, 68, 89, 63, 102/34.4, 69, 7.2

[56] References Cited

UNITED STATES PATENTS

| | | | |
|---|---|---|---|
| 1,039,850 | 10/1912 | Voller | 102/67 |
| 1,240,217 | 9/1917 | Ingram | 102/67 |
| 1,312,764 | 8/1919 | Straub | 102/63 |

FOREIGN PATENTS OR APPLICATIONS

| | | | |
|---|---|---|---|
| 312,389 | 2/1902 | Germany | 102/67 |

*Primary Examiner*—Verlin R. Pendegrass
*Attorney, Agent, or Firm*—Nathan Edelberg; A. Victor Erkkila

EXEMPLARY CLAIM

1. Anti-personnel ammunition capable of direct and indirect fire comprising
   - a body having a nose end and a base end
   - an explosive charge positioned within said body adjacent its base end
   - a multiplicity of anti-personnel fin stabilized flechettes within said body arranged in at least one layer between said explosive charge and said nose end
   - means positioned centrally in said body and along a longitudinal axis of said body extending from a point adjacent said explosive charge to a point adjacent said body nose end and having a passageway therethrough for conducting an ignition flash to said explosive charge
   - timer fuzing means adjustable for substantially immediate action in one position and for delayed action in other positions
   - adapter means for assembling said fuzing means to said body nose end
   - relay explosive means positioned between said fuzing means and said ignition flash conducting means, and
   - a plurality of detonators in said adapter means and positioned radially of and in spaced relation to said relay explosive means, said adapter means having lateral passage means communicatively interconnecting said detonators and relay explosive means.

5 Claims, 5 Drawing Figures

INVENTOR.
JOHN F. ROWE
BY: Harry M. Saragovitz, Edward J. Kelly, Herbert Berl & S. Dubroff ATTORNEYS:

INVENTOR.
JOHN F. ROWE
BY: Harry M. Saragovitz,
Edward J. Kelly,
Herbert Berl &
S. Dubroff
ATTORNEYS:

BEEHIVE PROJECTILE

The invention described herein may be manufactured and used by or for the Government for governmental purposes without the payment to me of any royalty thereon.

This invention relates to anti-personnel ammunition and particularly to anti-personnel ammunition capable of direct and indirect fire as defined by U.S. Army artillery usage and which depends upon the contents of the ammunition performing the anti-personnel work rather than fragments resulting from the bursting of a shell body.

It was discovered early, in the use of cannon and artillery pieces, that they were no defense against close-up charge of troops. Thus the expedients of the so-called "grape-shot" and the like were developed, wherein a large number of fragments of various forms or shapes were loaded in the weapon and fired at point blank range. This principle was extended further with the development of modern cannister ammunition wherein a shell body was designed specifically for containing a multiplicity of fragments and adapted for firing at point blank range. The ammunition is designed to open substantially immediately after exit from the muzzle of the weapon. As is well known in the art, the fragments will disperse in relation to the twist of the rifling in the weapon. Since this ammunition functioned substantially at the muzzle of the weapon its beneficial anti-personnel effect could not be utilized at ranges other than essentially point blank.

It is, therefore, an object of this invention to provide improved anti-personnel ammunition containing highly efficient, low drag fragments, suitable for use at longer, so-called, howitzer or artillery ranges, while at the same time having the necessary point-blank range capabilities, and having the same aerodynamic configuration as the other ammunition fired from the same weapon.

The invention may be more completely understood when viewed in connection with the attached drawings in which.

Figure 2:
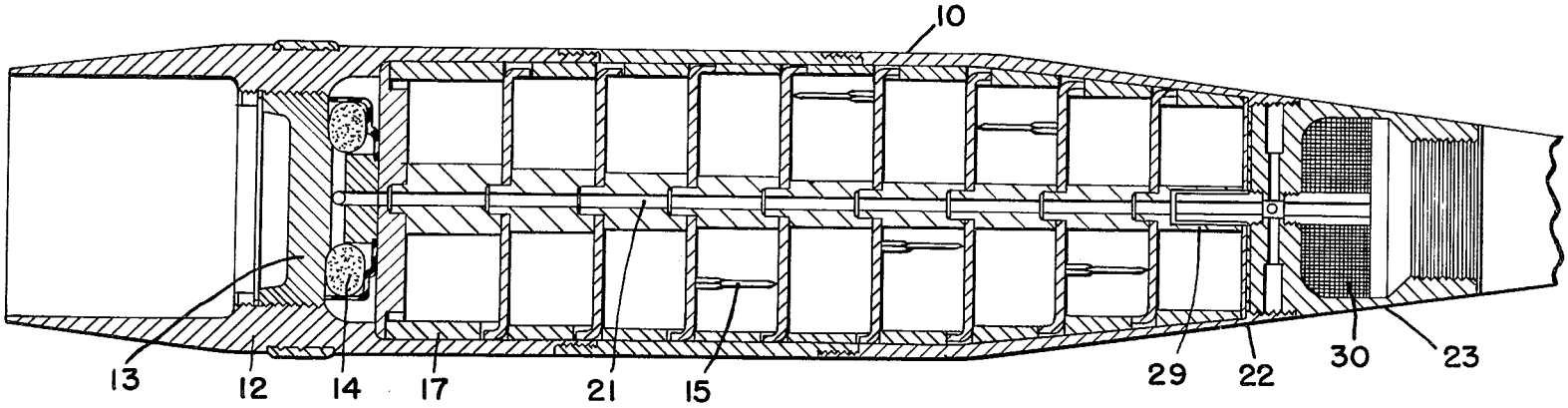
FIG. 2 is a cross sectional view of the same assembly shown in FIG. 1.

A preferred embodiment of the inventive ammunition comprises a shell body 10 and a fuze 11, usually of the variable time type, but which may be of any suitable design capable of yielding function at the muzzle as well as at some delayed period. For ease of assembly and manufacture the shell body may be made in a plurality of longitudinal sections and joined together by threads or other suitable means. Also for ease of assembly and manufacture the base end 12 may be one piece of a multiplicity of sections. In the embodiment of FIG. 2 the base end has a closing plug 13 which aids in the assembly by allowing for loading of the explosive charge 14 after the other components are assembled thus allowing for handling, without explosives, during the assembly operation.

Figure 1:
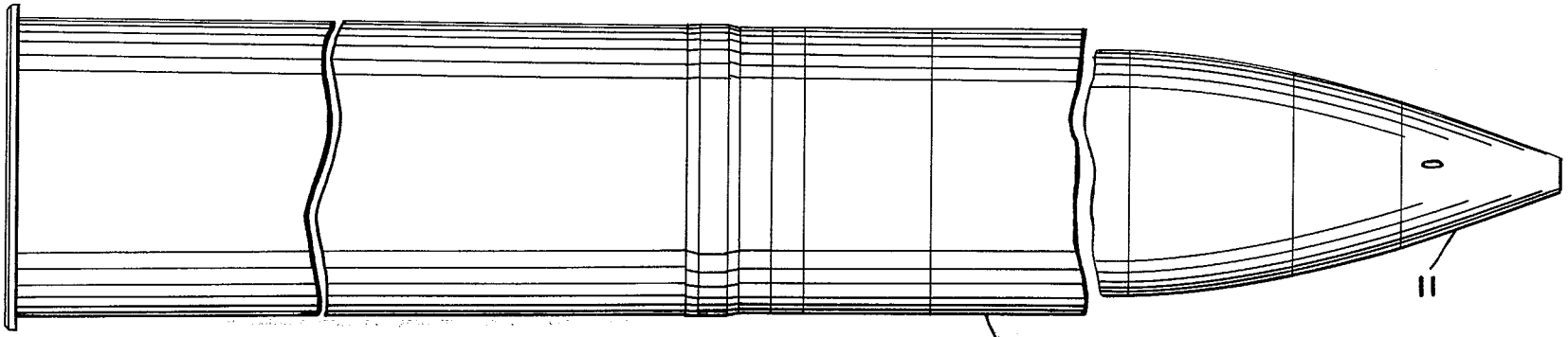
FIG. 1 is an external view of the shell and fuze assembly.
Figure 5:
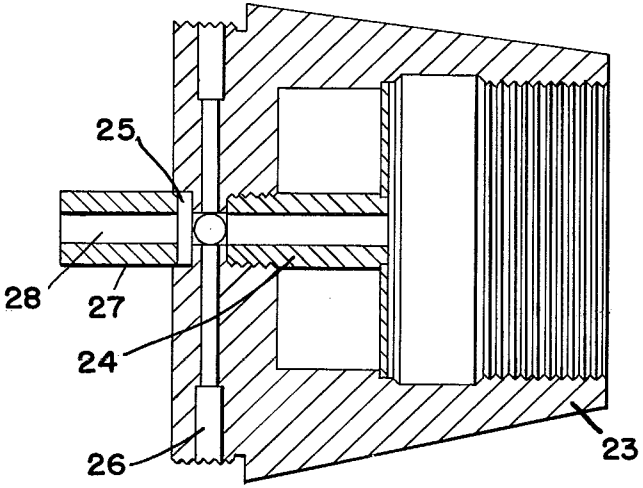
FIG. 5 is a section view of the nose adapter.
Figure 4:
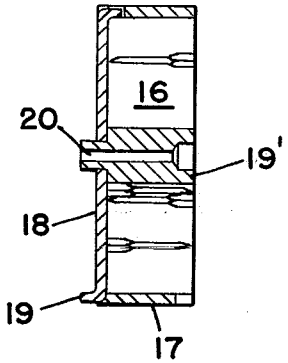
FIG. 4 is a view of an assembled layer of fragments.

The fragments used in this invention are in the form of fin-stabilized projectiles or flechettes 15 usually made of hard material such as steel, by known manufacturing techniques. In order to obtain maximum loading density, that is, the greatest number of fragments, the flechettes are loaded head to tail for each layer. For ease of assembly the fragments are assembled head to in layers or patties called bay assemblies 16, as shown in FIG. 4.

The bay assembly has an outer spacer 17 which may be solid or comprise a multiplicity of parts. This spacer has a height such that upon assembly of the many bays there is a clearance between the support of one and the flechettes of the next. Thus the flechettes bear only their own weight on setback when the shell is fired. Each outer support is thick enough to support the weight of all of the bay assemblies forward of it upon setback, when the shell is fired. The bay assembly also has a support 18 which has one or more protrusions or extensions 19 for keying one level to the next to provide rotation relative to the shell body. The inner spacer 19' has a passageway 20 therethrough so that upon the assembly of all the bay assemblies in the body there is a continuous passageway 21 down through the shell to the explosive charge 14.

At the front or nose end 22 of the shell there is located an adapter 23 which provides the assembly link between the fuze and the shell body. The adapter 23 has located centrally and longitudinally a forward tube 24 for conducting the flash from the fuze 11 to the relay charge 25. Positioned radially outward from the relay charge 25 are a plurality of explosive charges or detonators 26 (in this embodiment, four). A rear tube 27, upon assembly, is recessed within the inner spacer 29 of the first assembly and is axially aligned with the passageway 21 through all the bay assemblies. This rear tube 27 contains an explosive charge or detonator 28 which provides the igniting flash for the explosive charge 14.

Positioned in the forward end of the adapter 23 is a long burning explosive or smoke or incendiary charge 30 used for marking or spotting the position of the burst of the shell and frequently contains coloring substances, well known in the art, for more easily spotting the position of burst.

OPERATION

Prior to inserting the shell into a weapon, the variable time fuze, well known in the art, is set for muzzle burst or delayed time burst. The shell is inserted in the weapon (either assembled with its propellant charge in a cartridge case or separately therefrom, depending upon the weapon).

Figure 3:
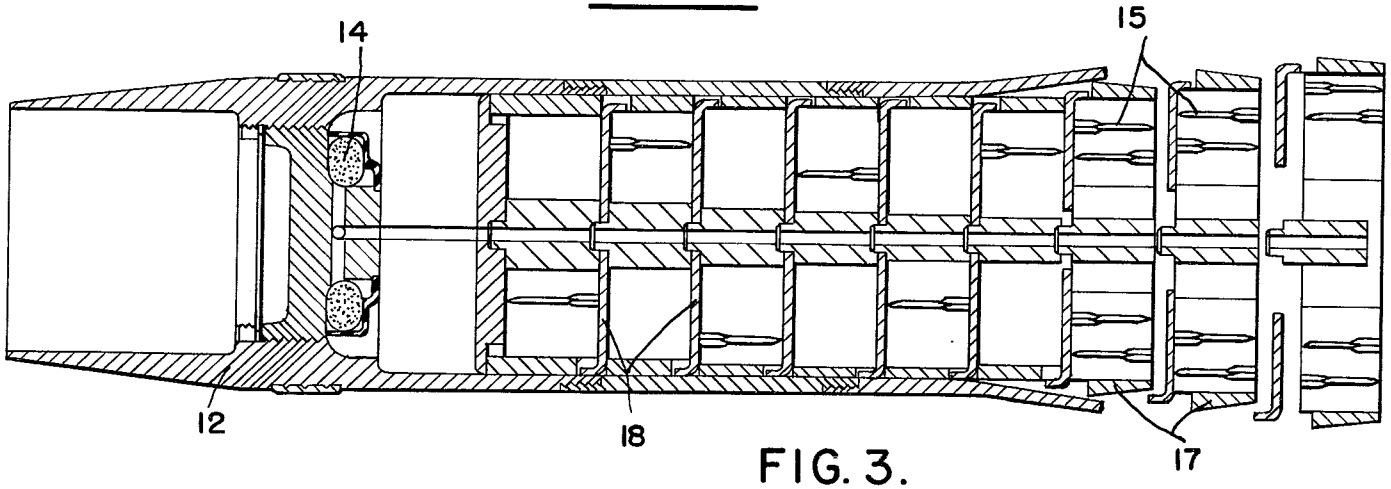
FIG. 3 is a view of the shell in flight after fuze function.

After the shell is fired from the weapon and upon fuze function (instant upon leaving the weapon or delayed time at longer ranges) the flash from the fuze ignites the spotting charge 30, and at the same time passes rearwardly through the forward tube 24 to ignite the relay charge 25. From the relay charge 25 the flash branches out to ignite the detonators 26, and the explosive force from the detonators rip open the forward end of the shell body (see FIG. 3). (The shell body may have a plurality of longitudinal grooves or scores to aid in this ripping and splitting action.) A portion of the flash from the relay charge 25 passes through the rear tube 27 to ignite another detonator 28. The ignition of this detonator 28 causes an explosive flash to travel rearward through the passageway 21 to ignite the explosive charge 14 creating a pressure at the base of the shell (but not sufficient to burst the shell) and exerting a force on the rearmost bay assembly sufficient to force the layers of bay assemblies forward and out of the front end of shell body, which, by this time, has been freed of any obstructions due to the ripping open of the front end, the fuze having fallen away. The longer burning spotting charge is also now readily observable.

I claim:

1. Anti-personnel ammunition capable of direct and indirect fire comprising a body having a nose end and a base end an explosive charge positioned within said body adjacent its base end a multiplicity of anti-personnel fin stabilized flechettes within said body arranged in at least one layer between said explosive charge and said nose end means positioned centrally in said body and along a longitudinal axis of said body extending from a point adjacent said explosive charge to a point adjacent said body nose end and having a passageway therethrough for conducting an ignition flash to said explosive charge timer fuzing means adjustable for substantially immediate action in one position and for delayed action in other positions adapter means for assembling said fuzing means to said body nose end relay explosive means positioned between said fuzing means and said ignition flash conducting means, and a plurality of detonators in said adapter means and positioned radially of and in spaced relation to said relay explosive means, said adapter means having lateral passage means communicatively interconnecting said detonators and relay explosive means.

2. The combination of claim 1 in which said flechettes are arranged in separately supported layers, said body is divided into a plurality of longitudinal sections and means for joining said sections to form a unitary assembly.

3. The combination according to claim 2 in which said separately supported layers of anti-personnel flechettes are unitary assemblies, each having a flat cylindrical support, an inner spacer, having a longitudinal passageway therein and positioned centrally said support, a cylindrical outer spacer having an outside diameter substantially the same as the inside diameter of said body and a thickness sufficient to support the weight of all of the bay assemblies forward it when the ammunition is fired, means for assembling said unitary assemblies for preventing relative rotation, means for assuring alignment of the passageways in said inner supports, and a multiplicity of anti-personnel fragments positioned between said inner and outer supports.

4. The combination of claim 3 in which said anti-personnel fin-stablilized flechettes have a length less than the height of said outer spacer.

5. The combination of claim 4 in which said fin-stabilized flechettes are arranged alternately head to tail.

* * * * *